United States Patent [19]

Wiener et al.

[11] Patent Number: 4,630,462

[45] Date of Patent: Dec. 23, 1986

[54] TOOL FOR CRIMPING CABLE SHOE TERMINALS

[75] Inventors: Hans Wiener, Täby; Hans Undin, Åkersberga, both of Sweden

[73] Assignee: C. A. Weidmuller GmbH & Co., Detmold, Fed. Rep. of Germany

[21] Appl. No.: 710,856

[22] Filed: Mar. 12, 1985

[30] Foreign Application Priority Data

Jan. 3, 1985 [SE] Sweden ..... 8500018

[51] Int. Cl.[4] ..... B21D 7/06

[52] U.S. Cl. ..... 72/410; 72/427; 72/461; 29/751; 81/421

[58] Field of Search ..... 72/410, 409, 461, 427; 81/9.41, 9.42, 418, 421; 29/751, 243.56

[56] References Cited

U.S. PATENT DOCUMENTS

| | | | |
|---|---|---|---|
| 2,738,693 | 3/1956 | Logan | 72/410 |
| 2,829,549 | 4/1958 | Demler | 29/751 |
| 3,039,337 | 6/1962 | Stuart-Prince | 72/410 |
| 3,504,417 | 4/1970 | Filia | 72/410 |
| 3,523,351 | 8/1970 | Filia | 29/751 |
| 3,525,107 | 8/1970 | Hays | 72/410 |
| 3,553,999 | 1/1971 | Rommel | 72/410 |
| 4,048,877 | 9/1977 | Undin | 72/410 |

*Primary Examiner*—Daniel C. Crane

*Attorney, Agent, or Firm*—Karl F. Ross; Herbert Dubno

[57] ABSTRACT

A tool for crimping cable shoe terminals having an affixing part and a contact part onto the ends of electrical conductors has a pair of jaws provided with at least one pair of co-operating crimping dies and hinged together by a pivot pin. On the same pivot pin is mounted a rocker arm carrying for each pair of crimping dies a chamber accommodating the contact part of a terminal to be crimped. The rocker arm is affected by a position-controlling force such as friction at the location of mounting, and by suitably located dog means so that it makes a move, after the crimping operation has been terminated, by which the terminal, now crimped on a conductor, is lifted from the crimping die so that it readily can be removed from the tool.

20 Claims, 4 Drawing Figures

TOOL FOR CRIMPING CABLE SHOE TERMINALS

FIELD OF THE INVENTION

The invention relates to a plier-like appliance or tool for crimping cable shoe terminals of the kind having an affixing part for attachment to the end of an electrical conductor and a contact part for establishing electrical connection with some other electrical contact element.

BACKGROUND OF THE INVENTION

Terminals of the kind aforesaid are usually crimped in an appliance or a tool which is provided with a pair of jaws which can be moved toward one another and away one from another and which carry one or more pairs of co-operating crimping dies. The reason for providing more than one pair of crimping dies is to enable treatment of terminals with different affixing parts in one and the same tool.

In order to obtain a connection between the conductor and the terminal which is perfect in electrical, as well as in mechanical aspects, it is essential that the affixing part when being crimped, be exactly positioned in the pair of dies, while the contact part at the same time nust be absolutely clear of the dies.

It has been already proposed to provide crimping tongs with special stop means which shortly before and during the crimping operation define the position of a terminal inserted into the tool for treatment. Such a pair of pliers is described, e.g. in the European patent application of the present inventors published with No. 0124919 and corresponding to the U.S. patent application Ser. No. 599,236. This tool comprises a stop means in the shape of a double armed lever which is pivotally attached to the tool body at a location where also a pivotal jaw is affixed, i.e. the lever and the jaw are mounted on a common pivot pin. The forward arm of the lever extends into the region of the jaws of the tool and has a smooth, straight abutment edge, and the rear arm, which extends from the pivot point in the opposite direction, is affected by actuating means in such a manner that, when the tool is operated, the stop means performs rocking movements which, in one operational phase, bring said forward arm with the abutment edge in front of the affixing part of a terminal inserted into the tongs, and in another phase remove it from this region. The affixing part of the treated terminal is never positively grasped by some part of the stop means.

In the European patent application of the present inventors published with No. 0125708 and corresponding to the U.S. patent application Ser. No. 599,246 a pair of cable shoe pliers is described which has to one side of one jaw firmly attached a housing in which at least one track for the contact part of a terminal is arranged. The length of the track can be adjusted according to the length of the contact part of the treated terminal. Said track is embodied by an elongate chamber which tightly encloses the contact part and the contact part is positively retained in the chamber which, as it is fixed to one jaw of the pliers, follows all movements of the respective jaw.

OBJECT OF THE INVENTION

It is the principal object of the invention to provide an improved tool of the kind aforesaid, in which the position of the cable shoe which is being treated is exactly defined by having its contact part accommodated in a chamber, but where at the same time the crimped cable shoe is automatically brought into a free position in respect of both jaws as these are opened (moved apart). This is specially important in the case of cable shoes having outwardly projecting retaining springs ("outwardly" means in this context "opposite to the side from which the uncrimped affixing part projects").

SUMMARY OF THE INVENTION

These objects and others which will become apparent hereinafter are attained with a tool for crimping cable terminals having a contact part and an affixing part onto the ends of electrical conductors, and which according to the invention comprises, in combination, a first jaw having a free forward end and carrying at least one crimping die element; a second jaw having a free forward end and carrying at least one crimping die element complementing the die element of the first jaw to form therewith a pair of co-operating crimping dies; a pivot pin means pivotally connecting said two jaws spacedly from their forward ends for a swivelling motion between an open end position and a closed end position, and vice versa; driving means for driving said jaws in said motions; a rocker arm having a forward end, a rear end, an inner face and an outer face and mounted on said pivot pin means for swivelling motion between an initial position and a terminal position; at least one chamber at least partially closed upwardly for accommodating the contact part of a cable shoe to be treated in the tool, said chamber having an entrance opening and projecting outwardly from the outer face of the rocker arm and being located on said rocker arm adjacent each pair of co-operating crimping dies in the jaws; a first dog means on the rocker arm and a co-operating second dog means on the second jaw for defining said initial position of the rocker arm relative the second jaw so as to make said entrance opening freely accessible in said open end position of the two jaws; and means generating a position-controlling force by which the rocker arm is urged to keep unchanged its relative position in regard of the first jaw when not affected by another actuating force.

According to a feature of the invention, the said rocker arm may be at least at the location of its pivotal connection to the first jaw closely adjacent said jaw and said position-controlling force may be defined by the frictional force effective at said location between said inner face of the rocker arm and a side face of the first jaw turned toward said inner face, and a spring means may constantly press the rocker arm against the first jaw. Said spring means may be a Belleville spring mounted on said pivot pin means.

According to another feature of the invention, a spring means may, instead, be provided to constantly urge the rocker arm to swivel toward the free end of the first jaw, and the effect of this spring means may define the said position-controlling force, the spring means being, for example, a helical spring having at least one turn and two elongate, projecting legs of which one is anchored in the rocker arm.

Still another feature of the invention provides a third dog means to define said terminal position of the rocker arm, and one of said first and second dog means may be defined by one end of a groove and the other one by a tap freely movable in said groove, and the third dog means by the second end of said groove.

Yet another feature of the invention provides that one of said dog means is located on said inner face of the rocker arm and another on a side face of the second jaw which is turned toward said inner face.

BRIEF DESCRIPTION OF THE DRAWING

In order that the invention may be more readily understood, and so that further features thereof may be appreciated, specific embodiments thereof will now be described by way of example and with reference to the accompanying drawing in which.

SPECIFIC DESCRIPTION

Figure 1:
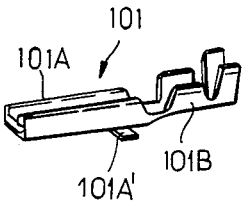
FIG. 1 is a view at an enlarged scale of a cable shoe terminal of a sort suitable for crimping on a cable end in the tool of the present invention.

Referring now to the drawing, wherein like reference characters designate like parts throughout the several views, a cable shoe 101 according to FIG. 1 is provided with a contact part 101A and an affixing or crimping on part 101B into which a conductor (not shown) may be inserted from the right hand side in the drawing in order to be retained by crimping. The contact part 101A is provided with an outwardly projecting resilient retainer hook 101A'. Cable shoes of this kind are known.

Figure 3:
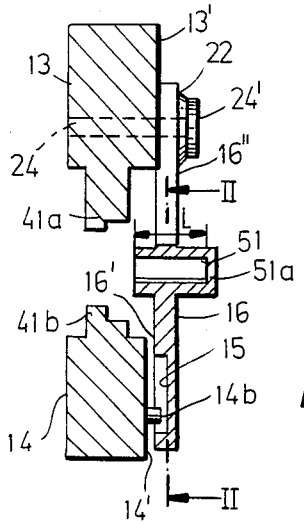
FIG. 3 is a diagrammatic cross-section along the line III—III in FIG. 2 through a forwardmost portion of the tool of FIG. 2.
Figure 2:
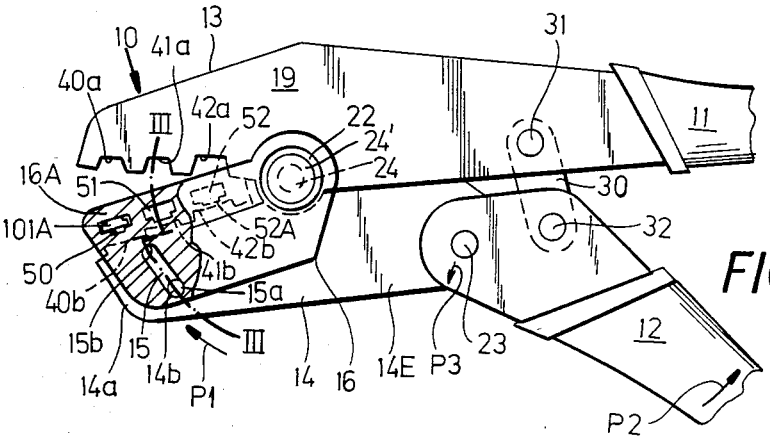
FIG. 2 is a diagrammatic side elevational view of the front part of a first embodiment of the tool of the invention with jaws in open state, taken generally along line II—II of FIG. 3.

According to FIGS. 2 and 3 the cable shoe tongs or pliers 10 are provided with a first jaw 13 and with a second jaw 14 which can be operated by a handle 12. The jaw 13 and a handle 11 are rigidly connected to form an elongate tool body 19. The second jaw 14 is pivoted to the first jaw 13, i.e. to the body 19, by means of a pivot pin 24. The handle 12 is, with the aid of a pivot pin 23, pivoted to the second jaw 14, and with the aid of a pivot pin 32 to one end of a connecting link 30. The connecting link 30 is at its other end pivoted to the tool body 19 with the aid of a pivot pin 31. The pivot pin 23 is located on a rear extension 14E of the jaw 14 beyond the pin 24.

The jaw pairs and the handle pairs are by a spring (not shown) held in the illustrated open position defined by an end stop (not shown). In the first jaw 13 are three crimping die elements **40*a*, 41*a*, 42*a*, and in the second jaw 14 there are three co-operating crimping die elements 40*b*, 41*b*, 42*b*** to define three crimping dies. Such a construction of tongs is known and lies outside the scope of the present invention.

In accordance with the present invention, a rocker arm 16 defining a single-arm-lever is, by the pivot pin 24, pivoted to the jaw 13 or the tool body 19 adjacent one side face 13' (FIG. 3) thereof. The rocker arm 19 extends parallel with the second jaw 14 towards the free forward end **14*a* thereof, i.e. it extends essentially only in the region in front of its pivot point defined by the pivot pin 24**.

A carrier pin **14*b* defining a first dog means projects from the side of the second jaw 14 in the region between the pivot pin 24 and the free forward end 14*a* of the jaw 14. In the inner face 16' (FIG. 3) of the rocker arm 16 which is turned toward said side of the jaw 14 is a groove 15 is provided which has the shape of a circular arc with a center of curvature at said pivot pin 24 and in which the carrier pin 14*b* freely can move. A Belleville spring 22 is mounted between the outer face 16'' of the rocker arm 16 and a head 24' of the pivot pin 24 so as to constantly press the rocker arm 16 with predetermined force against the first jaw 13 or the tool body 19, but not against the second jaw 14 which has the respective side face 14' somewhat set back from the corresponding face of the first jaw, as best seen in FIG. 3. By this arrangement, the normal friction between the adjacent faces 16', 13' of the rocker arm 16 and of the first jaw 13 is suitably increased. Moreover, at least one of said faces 13', 16'** can be provided with friction increasing means such as fluting, a suitable coating etc., but this measure is not always necessary.

The Belleville spring 24 can either be replaced by a spring of some other type, or a resilient means can be totally dispensed off, and the entire pressing force be exercised only by the head 24' of the pivot pin 24.

The friction between the rocker arm 16 and the first jaw 13, in whichever way it may be generated, ensures, as a position-controlling force, that the rocker arm 16 has no tendency not to change its position relative to the first jaw 13, regardless the movements and the position of the second jaw 14.

The rocker arm 16 is shown in FIG. 2 in its initial position relative to the second jaw 14, and this jaw is in its turn shown in the open end position, i.e. the end position in which the jaws 13, 14 are most apart. Said initial position of the rocker arm 16 is defined by the engagement of the carrier pin **14*b* with the first end 15*a* of the groove 15, said first end 15*a* being that which is more spaced from the first jaw 13** and which defines a second, co-operating dog means.

Close to the upper edge of the rocker arm 16 are chambers 50, 51, 52 provided for accommodating contact parts 101A of cable shoes 101 of various sizes, each accommodation chamber being in alignment with one of the crimping dies **40*a*/40*b*, 41*a*/41*b*, 42*a*/42*b*. The chambers encompass closely an inserted contact part and they are at least partially closed also upwardly, i.e. toward the first jaw 13, e.g. by an edge portion 16A of the rocker arm 16**.

Figure 4:
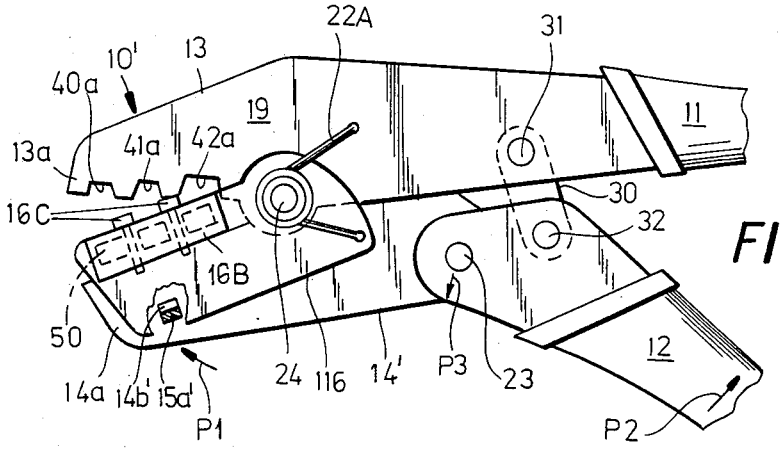
FIG. 4 is a diagrammatic side elevational view of the front part of a second embodiment of the tool of the invention with jaws in open state.

It will be understood from the study of FIGS. 2 and 3 that in the open position of the jaws 13, 14, and when the rocker arm 16 is in its initial position, all accommodation chambers 50, 51, 52 are freely accessible from the jaw side (i.e. from beneath the drawing plane in FIGS. 2 and 4 and from the left in FIG. 3). They may or may not be closed at the other end, e.g. by a wall **51*a* as shown in FIG. 3**.

Thus, the contact part 101A can be from the jaw side inserted into a selected chamber, e.g. 50, and the length L (FIG. 3) of the chamber is dimensioned so that the affixing part 101B of the respective cable shoe will occupy relative the crimping die **40*a*/ 40*b*** exactly the position which is necessary for perfect crimping.

When the second jaw 14, upon activation of the handle 12, begins its closing movement in the sense of arrow $P_2$, the carrier pin **14*b* is lifted from the first end 15*a* of the groove 15, but the rocker arm 16 maintains its position relative to the first jaw 13 unchanged, due to the position-controlling frictional force discussed above. However, the die element 40*b* will shortly engage the projecting affixing part 101B of the cable shoe 101 from beneath, whereby the contact part 101A** thereof will be pressed against the upper closing of the chamber 50, such as the part 16A of the rocker arm 16. The inserted cable shoe 101 itself begins thus to act as a dog means, which, overcoming said position-controlling frictional force, entrains the rocker arm 16 in a swivel movement in the sense of arrow $P_1$. This occurs until the affixing part 101B (into which the end of a conductor has been inserted) is completely crimped by the two die elements 40*a*, 40*b* (tongs of the present kind are usually provided with a locking mechanism which allows an opening of the jaws 13, 14 only after they have reached a predetermined closed end position). The rocker arm 16 has to swivel till the jaws 13, 14 have reached their closed end position. Consequently, the length of the groove 15 is selected so that the carrier pin 14*b* engages the second end 15*b* of the groove 15, which is less spaced from the first jaw 13, only after the two jaws 13, 14 have reached their closed end position. Apparently, the second end may be located still closer to the first jaw 13, or it may be quite absent (i.e. the groove 15 can be open upwardly). It is also evident that the groove 15 also may have any other broader shape than the arcuate one shown in the drawing, because the carrier pin 14*b* has no contact with the side edges of the groove 15.

When the carrier pin 14*b* strikes against said second end 15*b*, this end begins to operate as a further, i.e. third dog means defining a terminal position of the rocker arm 16, which, however, is not relevant to the operation of the tool. However, this third dog means prevents the rocker arm 16 from being swivelled out of its operational zone (i.e. rocked against the sense of arrow $P_1$) even if the position-controlling force would be overcome by some outer influence.

When, after the cable shoe 101 has been crimped, the second jaw 14 begins to move away from the first jaw 13 against the sense of arrow $P_1$, the rocker arm 16 stays at first, retained by the said position-controlling frictional force, in its position relative the first jaw 13, and the crimped cable shoe continues to bear against the die element 40*a* with its affixing part 101B. The other die element 40*b*, however, moves away from the cable shoe due to the opening movement of the second jaw 14.

The carrier pin 14*b*, when it due to this notion has reached the first end 15*a* of the groove 15, acts again as a dog means and takes along the rocker arm 16, i.e. swings it, against the action of the frictional force, in the reverse sense of arrow $P_1$. Thereby is the crimped cable shoe 101 positively lifted from the die element 40*a*, even if it possibly were firmly wedged therein by the crimping operation, and the rocker arm 16 adopts again its initial position, shown in the drawing, after the jaws 13, 14 have reached their open end position, also shown in the drawing. The cable shoe can readily be removed from the chamber 50, e.g. by a pull on the conductor, which now is firmly attached to the cable shoe, and the tool is ready for the next crimping operation.

The chambers 50 to 52 shown in FIG. 2 have a central recess such as 52A for the resilient hook 101A' (FIG. 1). Also this recess is, of course, fully exposed in the initial position of the rocker arm, i.e. not obstructed by the respective die element in the second jaw 14.

In FIG. 4 is shown an alternative embodiment 10' of the cable shoe tongs which differs from the embodiment 10 of FIG. 1 in three aspects.

First, the chambers 50 etc. are disposed in an interchangeable housing 16B which by means of screws is 16C mounted on the rocker arm 16. Housings with chambers for terminals with various affixing parts can thus be used as required. Second, instead of a Belleville spring, a spring 22A with at least one turn and with two legs is mounted on the pivot pin 24. One of the legs is anchored in the rocker arm 16 and the other one in the tool body 19 in such a manner that the forward end of the rocker arm 16 is constantly urged toward the forward end 13*a* of the first jaw 13. In distinction to the formerly described closing phase of the jaws 13, 14, the temporary dog action of an inserted cable shoe does not occur, due to the constant action of the spring 22. This difference is, however, irrelevant for the operation. The opening phase passes in exactly the same manner as described. The action of the spring 22A defines the position-controlling force in this case.

Third, the groove 15 is omitted, and in its stead is a projecting lug 15*a'* provided at the inner face of the rocker arm 116. The lug 15*a'* is in the initial position of the rocker arm 116 more spaced from the first jaw 13 than the carrier pin 14*b'* , mounted on the side face of the jaw 14'. The tap 15*a'* defines a dog means which replaces the first groove end 15*a* and it has been already stated above that the dog means defined by the second groove end 15*b* is not necessary in principle.

It will be readily realised that the dog means defined by the lug 15*a'* also can be embodied in some other way, e.g. as a lower edge of the rocker arm 116 turned inwardly.

Further modifications are of course possible within the scope of the present invention. For example the carrier pin can be provided on the inner side of the rocker arm and the groove in the side face of the tool body, or other types of springs may be used in the alternative embodiment of FIG. 4. The accommodation chambers may be adapted for different lengths of affixing parts in accordance with the said European patent application 0125708 (U.S. patent application Ser. No. 599,246). The invention may also be applied with crimping appliances which are driven in some other way than manually, e.g. hydraulically.

We claim:

1. A tool for crimping cable shoe terminals having a contact part and an affixing part onto the ends of electrical conductors and comprising in combinaton:

a pair of jaws, each jaw having a free forward end and a rear end, one jaw being a relatively fixed first jaw and the other jaw a relatively movable second jaw pivotable between an open end position and a closed end position in regard to the first jaw;

at least one die element at each said jaw, between which die elements the affixing part of a cable shoe is crimped when the second jaw has reached its closed end position;

a pivot pin means pivotally connecting said jaws one with another at their rear ends;

an actuating means for moving the second jaw between said end positions thereof;

a locator member for fixing in a predetermined position relative to a pair of said die elements a cable shoe to be treated, said member comprising a rocker arm having an inner face facing the pair of jaws, a forward end adjacent said free forward ends and a rear end adjacent said pivoted rear ends and being at that rear end pivotally mounted on said pivot pin means:

in said rocker arm, intermediate to both said ends thereof, and in alignment with each pair of said die elements, a retaining member for the contact part of a cable shoe to be treated, each said retaining element having an entrance opening defined by a continuous surface at said inner face and being in the direction toward the first jaw spanned by a bridging element;

a means for releasably urging said rocker arm to retain its relative pivotal position in regard to the first jaw;

a pair of coacting carrier means on the rocker arm and the second jaw respectively for pivoting, when in mutual engagement, the rocker arm into an initial position as the second jaw is pivoted into its open end position, said bridging element defining a means for carrying the rocker arm into a terminal position when the second jaw is pivoted into its closed end position so as to crimp fhe affixing part of said cable shoe between the die elements of the first and second jaws; said urging means releasably holding the rocker arm in said terminal position and said carrier means being located so as to reengage one another and thereby to carry the rocker arm, overruling the urging means, back into its initial position only after the second jaw already has executed a part of its return movement into the open end position, the just crimped affixing part being thus liberated from the die element in the first jaw when the second jaw commences the said return movement and the rocker arm is still retained in its terminal position, and is liberated from the die element in the second jaw after said reengagement has occurred.

2. The tool of claim 1 comprising a stop means defining said terminal position of the rocker arm.

3. The tool of claim 1 wherein one of said carrier means is located on said inner face of the rocker arm and the second carrier means is located on a side face of the second jaw opposite said inner face.

4. The tool of claim 3 wherein one of said carrier means is defined by a projecting tap and the other carrier means is defined by one end of a groove in which the tap freely moves.

5. The tool of claim 4 comprising a stop means defining said terminal position of the rocker arm and embodied by the other end of said groove.

6. The tool of claim 4 wherein said groove has the shape of a circular arc centered in the said pivot pin means.

7. The tool of claim 1 wherein said rocker arm is at least in the region of its pivotal attachment to the first jaw closely adjacent to said jaw and said urging means is defined by the frictional force effective between the second jaw and the rocker arm.

8. The tool of claim 7 wherein a spring means is provided to constantly press the inner face of the rocker arm toward an opposite side face of the second jaw.

9. The tool of claim 1 wherein the retaining member is defined by a chamber projecting from the rocker arm.

10. The tool of claim 1 wherein said urging means is defined by a spring constantly urging the rocker arm into its terminal position.

11. A tool for crimping cable shoe terminals having a contact part and an affixing part onto the ends of electrical conductors and comprising in combination:

a pair of jaws, each jaw having a free forward end and a rear end, one jaw being a relatively fixed first jaw and the other jaw a relatively movable second jaw pivotable between an open end position and a closed end position in regard to the first jaw;

at least one die element at each said jaw, between which die elements the affixing part of a cable shoe is crimped when the second jaw has reached its closed end position:

a pivot pin means pivotally connecting said jaws one with another at their rear ends;

an actuating means for moving the second jaw between said end positions thereof;

a locator member for fixing in predetermined position relative to a pair of said die elements a cable shoe to be treated, said member comprising a rocker arm having an inner face facing the pair of jaws, a forward end adjacent said free forward ends and a rear end adjacent said pivoted rear ends and being at that rear end pivotally mounted on said pivot pin means;

in said rocker arm, intermediate both said ends thereof, and in alignment with each pair of said die elements, a retaining member for the contact part of a cable shoe to be treated, each said retaining element having an entrance opening defined by a continuous surface at said inner face;

a means for releasably urging said rocker arm to retain its relative pivotal position in regard to the first jaw, said means being defined by a spring constantly urging the rocker arm into its terminal position;

a pair of coacting carrier means on the rocker arm and the second jaw respectively for pivoting, when in mutual engagement, the rocker arm into an initial position as the second jaw is pivoted into its open end position; said urging means releasably holding the rocker arm in said terminal position after the affixing part of said cable shoe has been crimped between the die elements of the first and second jaws and said carrier means being located so as to reengage one another and thereby to carry the rocker arm, overruling the urging means, back into its initial position only after the second jaw already has executed a part of its return movement into the open end position, the just crimped affixing part being thus liberated from the die element in the first jaw when the second jaw commences the said return movement and the rocker arm is still retained in its terminal position, and is liberated from the die element in the second jaw after said reengagement has occurred.

12. The tool of claim 11 comprising a stop means defining said terminal position of the rocker arm.

13. The tool of claim 11 wherein one of said carrier means is located on said inner face of the rocker arm and the second carrier means is located on a side face of the second jaw opposite said inner face.

14. The tool of claim 11 wherein one said carrier means is defined by a projecting tap and the other carrier means is defined by one end of a groove in which the tap freely moves.

15. The tool of claim 14 wherein said groove has the shape of a circular arc centered in said pivot pin means.

16. The tool of claim 11 comprising a stop means defining said terminal position of the rocker arm and embodied by the other end of said groove.

17. The tool of claim 11 wherein said spring means is defined by a helical spring having at least one turn by which it is mounted on said pivot pin means, and two elongated projecting legs of which one is anchored at the rocker arm.

18. The tool of claim 8, wherein the spring means is a Belleville spring mounted on said pivot pin means.

19. The tool of claim 9, wherein said accommodation chamber is arranged in a housing which is detachably mounted on said rocker arm.

20. The tool of claim 1, wherein the said entrance opening is located close to an edge of the rocker arm and the part of the rocker arm between said edge and said entrance opening partially closes said chamber upwardly defining said bridging element.

* * * * *